US008342073B2

(12) United States Patent
Chu et al.

(10) Patent No.: US 8,342,073 B2
(45) Date of Patent: Jan. 1, 2013

(54) COMPOSITE ARMOR, ARMOR SYSTEM AND VEHICLE INCLUDING ARMOR SYSTEM

(75) Inventors: Henry S. Chu, Idaho Falls, ID (US); Warren F. Jones, Idaho Falls, ID (US); Jeffrey M. Lacy, Idaho Falls, ID (US); Gary L. Thinnes, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 718 days.

(21) Appl. No.: 12/510,014

(22) Filed: Jul. 27, 2009

(65) Prior Publication Data

US 2012/0174758 A1 Jul. 12, 2012

(51) Int. Cl.
*F41H 5/06* (2006.01)
*F41H 5/18* (2006.01)
*F41H 7/02* (2006.01)

(52) U.S. Cl. ..... 89/36.01; 89/36.02; 89/36.13; 89/904; 89/910; 89/914; 89/929

(58) Field of Classification Search ..... 89/36.02, 89/36.03, 36.07, 36.008, 36.09, 36.13, 36.14, 89/36.15, 36.01
See application file for complete search history.

(56) References Cited

U.S. PATENT DOCUMENTS 1,136,325 A * 4/1915 Everett ..... 89/36.13
2,388,873 A * 11/1945 Schwab ..... 89/36.13
2,651,973 A * 9/1953 Elliott ..... 89/36.13
3,590,685 A * 7/1971 Lane ..... 89/36.09
4,444,089 A * 4/1984 Pietzsch et al. ..... 89/36.13
4,879,165 A 11/1989 Smith
5,045,371 A 9/1991 Calkins
5,060,553 A 10/1991 Jones
5,285,714 A * 2/1994 Sprafke ..... 89/37.03
5,447,091 A * 9/1995 Sutton ..... 89/36.03
5,576,508 A * 11/1996 Korpi ..... 89/36.01
6,314,858 B1 11/2001 Strasser et al.
6,497,966 B2 12/2002 Cohen
6,532,857 B1 3/2003 Shih et al.
7,082,868 B2 8/2006 Reichman
7,332,221 B2 2/2008 Aghajanian et al.
7,478,580 B1 * 1/2009 Parimi et al. ..... 89/36.13
7,895,932 B1 * 3/2011 Ohnstad ..... 89/36.13
2005/0188831 A1 9/2005 Squires et al.
2006/0060077 A1 3/2006 Lucuta et al.
2006/0065111 A1 3/2006 Henry
2007/0293107 A1 12/2007 Follo et al.
2008/0104735 A1 5/2008 Howland

* cited by examiner

*Primary Examiner* — Bret Hayes
(74) *Attorney, Agent, or Firm* — TraskBritt

(57) ABSTRACT

Composite armor panels are disclosed. Each panel comprises a plurality of functional layers comprising at least an outermost layer, an intermediate layer and a base layer. An armor system incorporating armor panels is also disclosed. Armor panels are mounted on carriages movably secured to adjacent rails of a rail system. Each panel may be moved on its associated rail and into partially overlapping relationship with another panel on an adjacent rail for protection against incoming ordnance from various directions. The rail system may be configured as at least a part of a ring, and be disposed about a hatch on a vehicle. Vehicles including an armor system are also disclosed.

22 Claims, 16 Drawing Sheets

COMPOSITE ARMOR, ARMOR SYSTEM AND VEHICLE INCLUDING ARMOR SYSTEM

CONTRACTUAL ORIGIN OF THE INVENTION

This invention was made with government support under DE-AC07-051D14517 awarded by the United States Department of Energy. The government has certain rights in the invention.

TECHNICAL FIELD

The invention relates generally to composite armor. More specifically, embodiments of the invention relate to relatively lightweight composite armor and to a selectively configurable armor system incorporating panels of composite armor, which may, but need not, be of the structure of an embodiment of the lightweight composite armor disclosed and claimed herein. Embodiments of the invention also relate to vehicles including an armor system.

BACKGROUND

Composite armor systems for protecting vehicles and personnel against incoming ordnance have been in existence for decades. As used herein, the term "ordnance" includes and encompasses not only inert projectiles from small arms, but also explosive-carrying projectiles, fragments propelled from explosion of such projectiles, and debris resulting from impact of projectiles and fragments, as well as from blast and shock waves from explosions of projectiles and other explosive ordnance including, but not limited to, mines and improvised explosive devices (known commonly as "IEDs"). As used herein, the term "composite armor" is a broad term, which includes and encompasses an armor structure comprising a plurality of associated, often, but not necessarily, superimposed and laminated, components, the materials and configuration of which is intended to provide protection against ordnance equivalent or superior to a single component armor structure having greater mass.

A significant advantage of composite armor for personnel and vehicular protection, relatively light weight, is well known. For personnel composite armor, the light weight preserves mobility and agility of those wearing such armor and ensures wear of such armor for protracted periods of time will not tire or even exhaust the wearer. In the case of vehicular composite armor, the light weight not only helps to preserve fuel economy and minimize the stress of usage of a given vehicle, which may be "up-armored" after its initial production, but may also result in the ability to employ lighter weight structural and drive components in an armored vehicle designed from its inception to utilize composite armor.

Existing composite armor systems for vehicles have demonstrated some effectiveness in protection against ordnance. However, many composite armor structures are somewhat difficult to fabricate, require relatively exotic materials, and may not be susceptible to high-volume production without significant defects. In addition, the conventional use of composite armor in vehicular armor systems has been in fixed armor. In other words, a conventional composite armor system employing a composite armor panel or panels, is immovably secured to an exterior or to a frame of a vehicle. Thus, there is no capability of deploying such a system for selective protection of personnel from a situation-specific threat posed from a particular direction or directions.

Therefore, it would be advantageous to develop a lightweight, robust, yet straightforward-to-produce composite armor structure. It would also be advantageous to develop a selectively configurable armor system incorporating panels of composite armor.

BRIEF SUMMARY

One embodiment of the invention comprises a composite armor structure in the form of a laminate including a plurality of primary layers that, for the sake of convenience and not by way of limitation, may be characterized as "functional" layers. An outermost functional layer comprises an array of hard pressureless-sintered silicon carbide tiles, each tile being individually wrapped in unidirectional carbon fibers pre-impregnated with an epoxy resin system in 0°/90° directional orientations. The next adjacent, intermediate functional layer comprises silicon carbide granular particles embedded in a polymeric resin, the layer being wrapped with a fiberglass cloth in 0°/90° directional layup. A further base functional layer, adjacent the intermediate layer, is a backing laminate comprising a plurality of layers of 3D 3TEX® fiberglass cloth pre-impregnated with an epoxy resin. The three functional layers are, together, wrapped in a fiberglass cloth pre-impregnated with an epoxy resin in 0°/90° directional orientations. A steel sheet is placed over the array of wrapped tiles between the outer wrap and the three functional layers.

Additional embodiments of the invention comprise an armor system including a plurality of movable, rail-mounted composite armor panels that may be mounted to a vehicle, such as an armored vehicle. The composite armor panels may be of the structure described in the foregoing embodiment, but the invention is not so limited. In this embodiment, each panel is associated with one or more carriages, which carriages are configured to provide support and stiffness in a direction substantially perpendicular to the armor panel face, as well as vertical support and capture, to prevent each panel from disengaging from that panel's respectively associated rail due to vehicular motion or projectile impact. Stated another way, any substantial panel movement in any direction transverse to a direction of elongation of the rail is precluded. In addition, in some embodiments the carriages are configured with a plurality of cam followers and bearings, in the form of rollers for engaging a rail mounted to a surface, for example, on a vehicle to which the armor system is mounted. In other embodiments, at least one among the carriages includes a slot arrangement on its underside configured to substantially correspond to a cross-sectional shape, or profile, of the rail on which that carriage is slidably mounted. In one embodiment, two rails comprising a rail system may be placed in substantially mutually parallel, spaced proximity, to enable a composite armor panel borne by a carriage engaged with one rail to overlap, and pass, a panel borne by a carriage on the adjacent rail. In one configuration, the rail system may be arcuate (curved), so as to at least partially surround, for example, a vehicle hatch. In a specific embodiment, the rail system may be configured to comprise substantially two-thirds)(240° or more of a circle. One of the rails may, of course, be longer than the other, and encompass a greater portion of the circle.

Yet another embodiment of the invention comprises a vehicle bearing an armor system. The term "vehicle" is used herein in its broadest sense, and includes and encompasses, by way of non-limiting example, not only land vehicles (e.g., vehicles with wheels or tracks), but also watercraft (e.g., vessels with displacement hulls, vehicles configured as hydroplanes), aircraft (e.g., helicopters) and multi-environment craft (e.g., hovercrafts).

DETAILED DESCRIPTION

Figure 1:
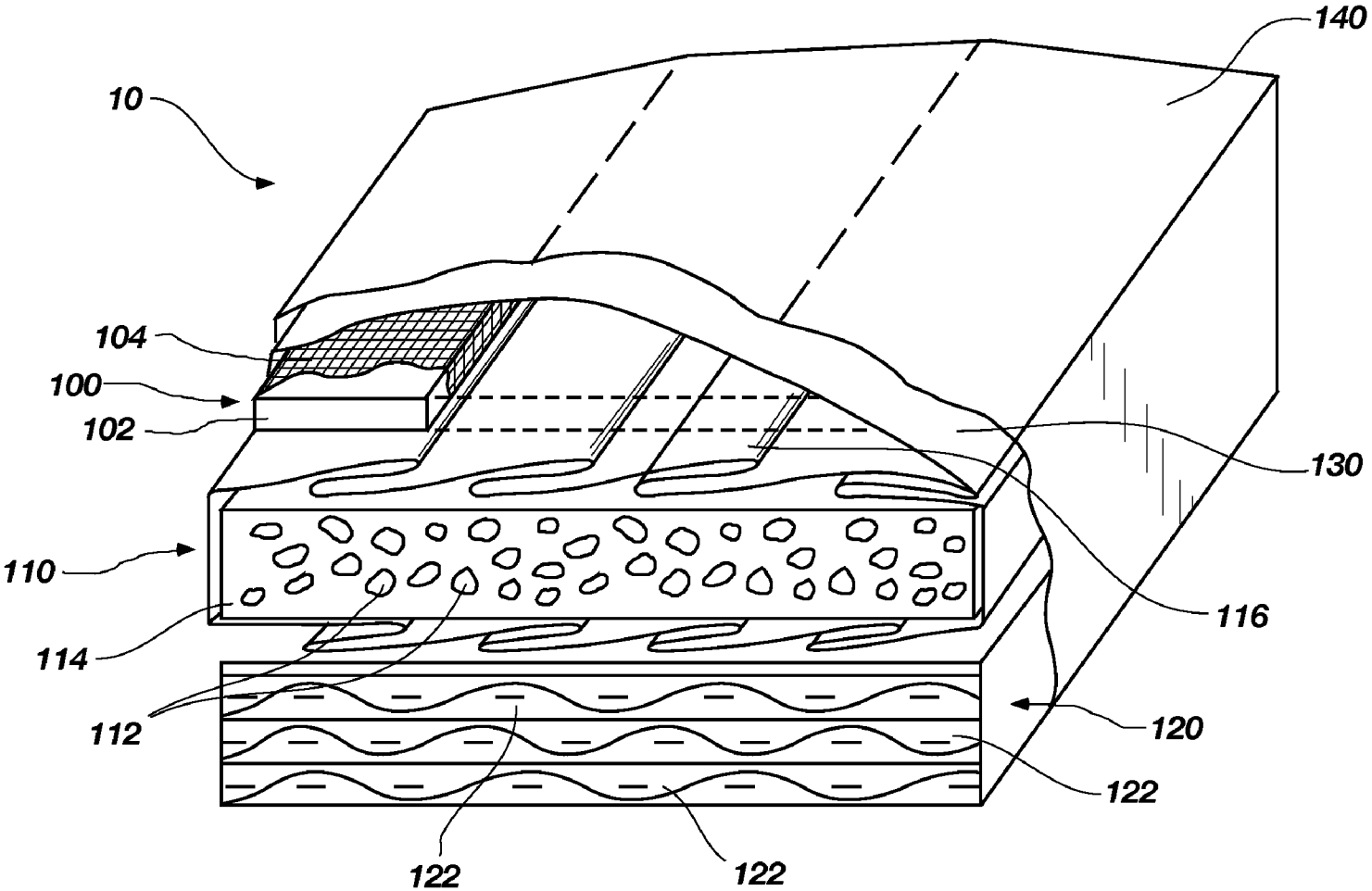
FIG. 1 is a schematic, partial sectional, perspective view of a composite armor panel according to an embodiment of the invention.

In the description that follows, the same or similar elements and features are identified by like reference numerals for clarity.

As used herein with respect to an armor panel, the term "outermost" is indicative of the layer or surface of the armor panel to be oriented facing a direction of an incoming threat in the form of, for example, a projectile, fragment or blast or shock wave. Accordingly, there is no requirement that the layer or surface be exposed and, so, the term encompasses a layer or surface of an armor panel that may be covered, by way of non-limiting example, with a fabric, paint, or other cover or coating.

Referring now to FIG. 1, an embodiment of composite armor panel 10 is depicted. As depicted, composite armor panel 10 comprises a plurality of functional layers serving various functions, in combination with additional components. In one embodiment, armor panel is approximately fifteen to sixteen inches square.

Outermost functional layer 100 comprises an array of mutually laterally adjacent pressureless-sintered silicon carbide tiles 102. In one embodiment, the tiles 102 are square, five inches by five inches (5"×5") in lateral dimension, of a thickness between about 0.5 inch and about 0.675 inch, and having a minimum density of about 3.15 g/cm$^3$. Each tile 102 is individually wrapped with a structure of unidirectional carbon fibers 104 pre-impregnated with an epoxy resin system in 0°/90° orientations, taken with respect to a major, X-Y plane of the tile 102 (e.g., transverse to the thickness of the tile). One suitable pre-impregnated carbon fiber 104 is available from Patz Materials and Technologies (hereinafter "Patz"), of Benicia, CA, using a Patz PMTF1 resin system in combination with IM7 carbon fiber produced by Hexcel. The fiber weight is 200 g/m$^2$, and the resin content about 28% by weight.

Adjacent outermost functional layer 100, intermediate functional layer 110 comprises black silicon carbide granular particles 112 embedded in a cast proprietary, toughened polymeric resin matrix 114, designated PMTF5 and offered by Patz. The black silicon carbide granular particles 112 may desirably range from at least about 7 mm in diameter to no more than about 9 mm in diameter, the term "diameter" being generally indicative of the size of the particles, which are not perfectly spherical but are granular. The particle size is also designated with respect to conventional particle size distribution criteria, it being understood that some minor portion of granules within the aforementioned nominal range may, in fact, lie outside of it. It is believed that green silicon carbide particles would offer equivalent performance for the application. Suitable granular particles are available from Panadyne, of Warminster, PA. The silicon carbide particles 112 are placed in a mold and packed by hand so that the particles 112 are substantially in mutual contact. The liquid, uncured material for forming the polymeric resin matrix 114 is then poured into the mold in a volume sufficient to substantially fill the voids between the silicon carbide particles 112. The mold is then placed in an oven at a 275° F. temperature for two (2) hours, which effects a substantially full cure to form the structure of intermediate functional layer 110.

The relative weight of the material of polymeric resin matrix 114 to the silicon carbide particles 112 was kept approximately under thirty percent (30%) of the total weight of the intermediate functional layer 110 comprising the silicon carbide particles 112 and the polymeric resin matrix 114. Curing will slightly affect the ultimate weight proportions. It is desirable that there be a thin (less than 0.010 inch) layer of polymeric resin matrix 114 between each grain of silicon carbide. It is recognized, however, that larger voids may exist between the grains, due to packing inefficiency. Thus, the relatively high weight percent of resin required. However, the larger voids do not appear to compromise the integrity of the intermediate functional layer 110 if a majority of the silicon carbide grains are in close proximity, and the resin material fills substantially all of the aforementioned voids.

Intermediate functional layer 110 is wrapped in fiberglass cloth 116, overlapped in a "dog ear" arrangement and in 0°/90° directional iayups. In other words, the fiberglass cloth 116 is laid up in one direction with overlapping dog ears, and then in another direction, again with overlapping dog ears, 90° rotationally offset from the first direction, taken with respect to a major, X-Y plane of intermediate functional layer 110 (e.g., transverse to a thickness of the intermediate functional layer). It is also contemplated that the fiberglass cloth 116 may be dog-eared in only one direction and straight-wrapped in the 90° offset direction. One suitable fiberglass cloth is 100 oz. 3WEAVE® S2 Fabric, commercially available from 3Tex of Cary, NC.

The relatively high volume of silicon carbide granular particles 112 in intermediate functional layer 110 yields a resulting structure with very high compression modulus, offering resistance to penetration by any solid particles or fragments breaching outermost functional layer 100. However, as internal pressure builds up in intermediate functional layer 110 in reaction to impact pressure of an incoming projectile, intermediate layer 110 expands and may eventually burst. However, the dog-ear wrap of the fiberglass cloth 116 in conjunction with the polymeric resin matrix 114 bonding the silicon carbide granular particles 112 is believed to help absorb the majority of the impact pressure (e.g., mechanical energy), delaying the burst until the bonding strength threshold of the resin of the matrix is exceeded and the dog-ear wrap of the fiberglass cloth fails in tension. Further, failure of intermediate functional layer 110 by bursting prevents the transmission of residual pressure and consequent mechanical energy to base functional layer 120, which is described below. Stated another way, the behavior of intermediate functional layer 110 under impact decouples potentially damaging energy from base functionional layer 120.

Adjacent intermediate functional layer 110, base functional layer 120 comprises a laminate including a plurality of layers or plies 122 of 100 oz. 3WEAVE® S2Fabric, available from 3Tex and pre-impregnated with a PMTFX resin system, offered by Patz. A suitable number of layers 122 may range from about thirteen (13) to about nine (9) layers, which layers 122 may also be characterizable as plies 122. This laminate stack is cured at 275° F. for three (3) hours in a sealed vacuum bag at 28 inches of mercury vacuum pressure. It is desirable that the volume of resin deposited on each side of the 3WEAVE® S2 Fabric (fiberglass cloth) be evenly and precisely controlled, and that the volume of resin in the structure is maintained under thirty percent (30%) in the stack of laid-up plies 122. The curing temperature depends upon the resin type employed, and the necessity to avoid harming and degrading the material of the fiberglass cloth employed. As panel weight is a consideration for placement on vehicles, the number of layers or plies 122 may be selected to defeat anticipated projectiles without unduly adding to panel weight. The layers or plies 122 as described above weigh about 0.56 lb per square foot. A thin steel sheet 130 is located over the outermost functional layer 100.

In one embodiment, the steel may be one-sixteenth inch (1/16") thick commercial grade carbon sheet steel.

In fabrication of the composite armor panel 10, intermediate functional layer 110 is preformed, wrapped in fiberglass and placed on a preformed base functional layer 120, after which the silicon carbide tiles 102 wrapped in resin-impregnated carbon fiber are placed in an array over intermediate functional layer 110 to form outermost functional layer 100. A steel sheet 130 is placed over the array of silicon carbide tiles 102, and the assembly of steel sheet 130, outermost function layer 100, intermediate functional layer 110 and base functional layer 120 is over-wrapped in fiberglass cloth 140 pre-impregnated with PMTFX resin in 0°/90° directional orientations, taken with respect to a major, X-Y plane of composite armor panel 10 (e.g., transverse to a thickness of the panel). One suitable fiberglass cloth 140 is HEXCEL® 4533 glass fabric, available from Hexcel Corporation of Dublin, CA. The over-wrapped structure is vacuum-bag cured at about 275° F. for three hours in an atmospheric pressure oven.

The outermost functional layer 100 is designed to intercept and stop projectiles in the form of incoming ordnance and blast fragments. The intermediate functional layer 110 is designed to disperse and decouple shock pressure from ordnance, fragments and blast and shock waves from transmitting to base functional layer 120 and structure supporting composite armor panel 10. The base functional layer 120 provides structural support for outermost functional layer 100 and intermediate functional layer 110. The composite armor panel 10 is designed to defeat, by way of non-limiting example, .30 caliber armor piercing projectiles, 20 mm 830+/−4 grain fragments, and blast shock pressure of a 155 mm shell-based IED.

In testing, prototypes of an embodiment of composite armor panel 10 as described above using 7 mm to 9 mm silicon carbide granular particles 112 in intermediate functional layer 110 and between nine (9) and thirteen (13) laminate plies 122 in base functional layer 120 was proven capable of stopping an 830+/−4 grain (20 mm diameter) fragment-simulating projectile launched at 4000 ft/sec at a standoff distance of 20 feet. The panel design, using eleven (11) plies 122 in base functional layer 120, was also found capable of stopping .30 caliber armor piercing projectiles (U.S. military designation M2 AP) at a muzzle velocity of 2800 ft/sec at a standoff distance of 20 feet. The panel design, using thirteen (13) plies 122 in base functional layer 120, has been tested successfully against .50 caliber armor piercing projectiles (U.S. military designation M2 AP) at a muzzle velocity of 2900 ft/sec at a 20 foot standoff distance. In addition, the composite armor panel stopped .50 caliber armor piercing projectiles at the foregoing muzzle velocity and standoff distance after being variously soaked in water for 24 hours, hot soaked in water at 108° F. for 24 hours, and frozen at −30° F. in dry ice solution for 24 hours, demonstrating its durability and sustainable performance in hostile environments.

The foregoing tests indicate that base functional layer 120 of composite armor panel 10 remains undisturbed in appearance even after a large caliber projectile, such as a .50 caliber armor piercing projectile, was stopped. It is believed that the structure of intermediate functional layer 110 is significant to consistently and reliably defeat a .50 caliber armor piercing projectile, or a massive 20 mm (830 grain) burst fragment simulating a projectile launched from a very short range at a high muzzle velocity.

In another embodiment, and with reference to FIGS. 2A through 9 of the drawings, the invention comprises an armor system 200 and a further embodiment comprises a vehicle bearing such an armor system 200.

Figure 2B:
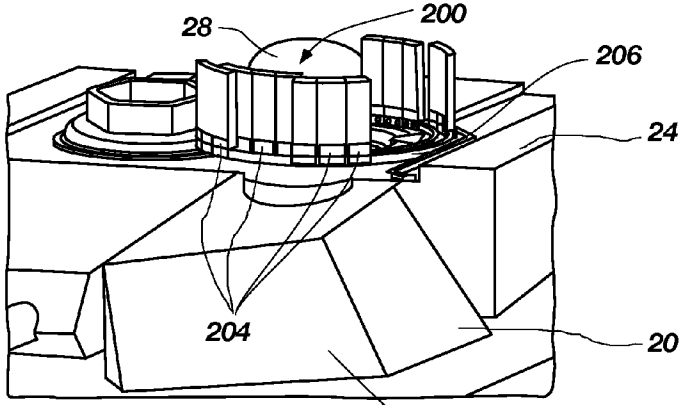
FIGS. 2A through 2C are, respectively, two different perspective views and a top elevation of an armor system comprising a plurality of movable, rail-mounted armor panels, according to an embodiment of the invention, mounted to a surface of an armored vehicle.
Figure 2C:
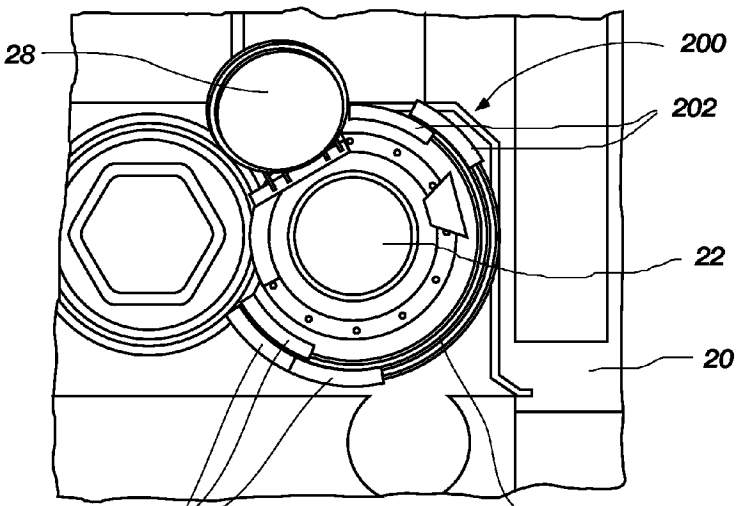
Figure 2A:
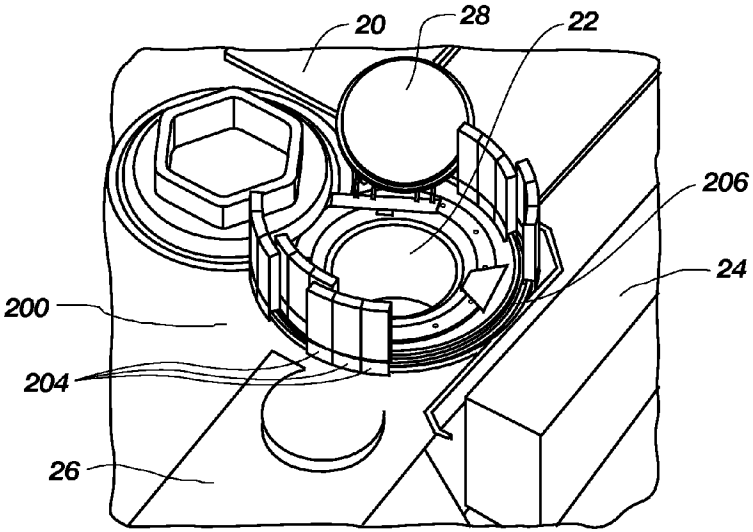

Referring to FIGS. 2A through 2C, an embodiment of armor system 200 is depicted installed on an armored vehicle 20, for example, proximate a loader's hatch 22 next to ammunition storage 24 adjacent gun turret 26 or, as another non-limiting example, a gun turret opening in which a gunner may stand. Armor system 200 comprises a plurality of armor panels 202, which may be configured as composite armor panels 10, but the embodiment is not so limited. Armor panels 202 are borne by carriages 204 which, in turn, are each movably secured to a rail of multi-rail, rail system 206 secured to a surface of the armored vehicle 20. Thus, armor panels 202 may be moved to protect a gun loader or other person carried by the armored vehicle 20 when his upper body is exposed through the opening of loader's hatch 22, with respect to perceived or potential threats from various directions radial directions, including from positive and negative elevations with respect to the protected area. In other words, armor panels 202 on rails of rail system 206 may be moved along a rail into partially overlapping relationship to protect personnel with respect to substantially any desired threat direction.

Figure 2D:
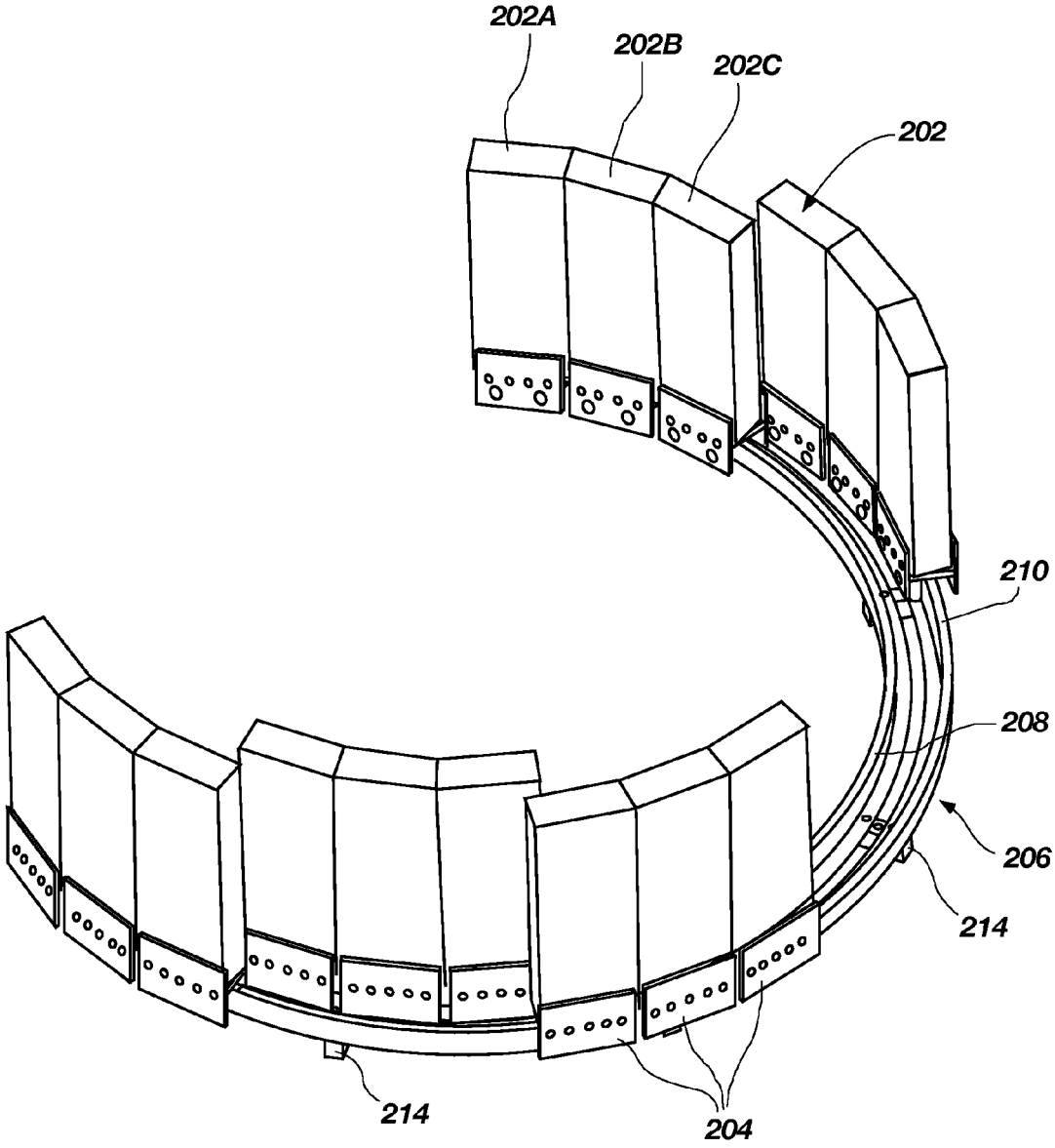
FIG. 2D is an enlarged perspective view of the armor system of FIGS. 2A through 2C.

Referring to FIG. 2D, it will be appreciated that rail system 206 is of arcuate configuration and comprises mutually spaced inner and outer rails 208, 210 in substantially constant spaced relationship. As illustrated, rail system 206 traverses almost three-quarters of a circle, the arc being limited to such only by the presence of other structures, such as a hatch cover 28, on the vehicle in proximity to loader's hatch 22, as is best shown in FIG. 2C. Accordingly, rail system 206 may also be referred to as a "base ring" for armor system 200, and rails 208, 210 are concentrically positioned. Rails 208, 210 may be of the same or different lengths. As shown in, for example, FIG. 7 of the drawings, inner rail 208 may traverse a larger arc, for example, about 242°, than outer rail 210, which may traverse a smaller arc, for example, about 218°. Each of rails 208, 210 is secured via fasteners 216, which may comprise threaded bolts, extending through apertures 270 periodically placed in spaced relationship along the bases 272 (FIG. 6) of rails 208, 210 and into supports 214 mounted to a vehicle on an exterior surface thereof. Supports 214 may be mounted, for example, by threaded bolts (not shown). Armor panels 202 may be of multi-planar configuration, approximating a radius of curvature of an arc traversed by rail system 206, each planar segment 202A, 202B and 202C of an armor panel 202 being borne by, and secured to, a carriage 204. Alternatively, armor panels 202 may be of partially or even continuously curved configuration, traversing an arc defined by a radius of curvature. With such a configuration, an appropriate number of suitably configured carriages 204 would be employed to support a curved armor panel 202. The armor panels 202, when movably mounted on carriages 204 along rails 208, 210, provide a variable "arc of protection" to personnel located within the base ring, for example, standing in a vehicle hatch opening 22 having the base ring located therearound. The configurations of rail system 206, armor panels 202 and carriages 204 are described hereinbelow in more detail.

Figure 3A:
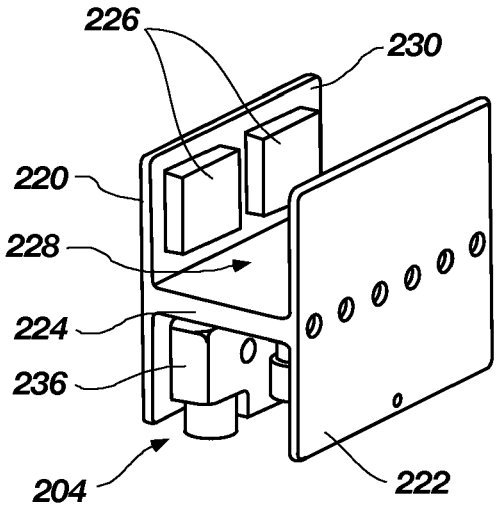
FIGS. 3A and 3B are two different, perspective views of a carriage configuration suitable for use in an embodiment of the invention.
Figure 3B:
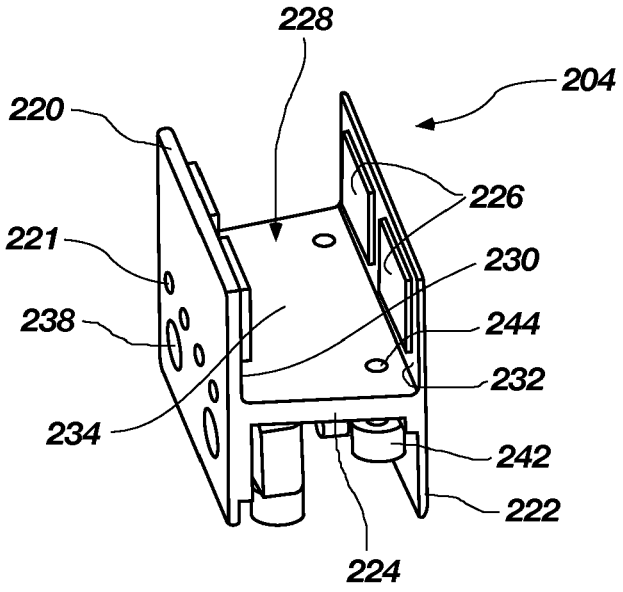
Figure 3C:
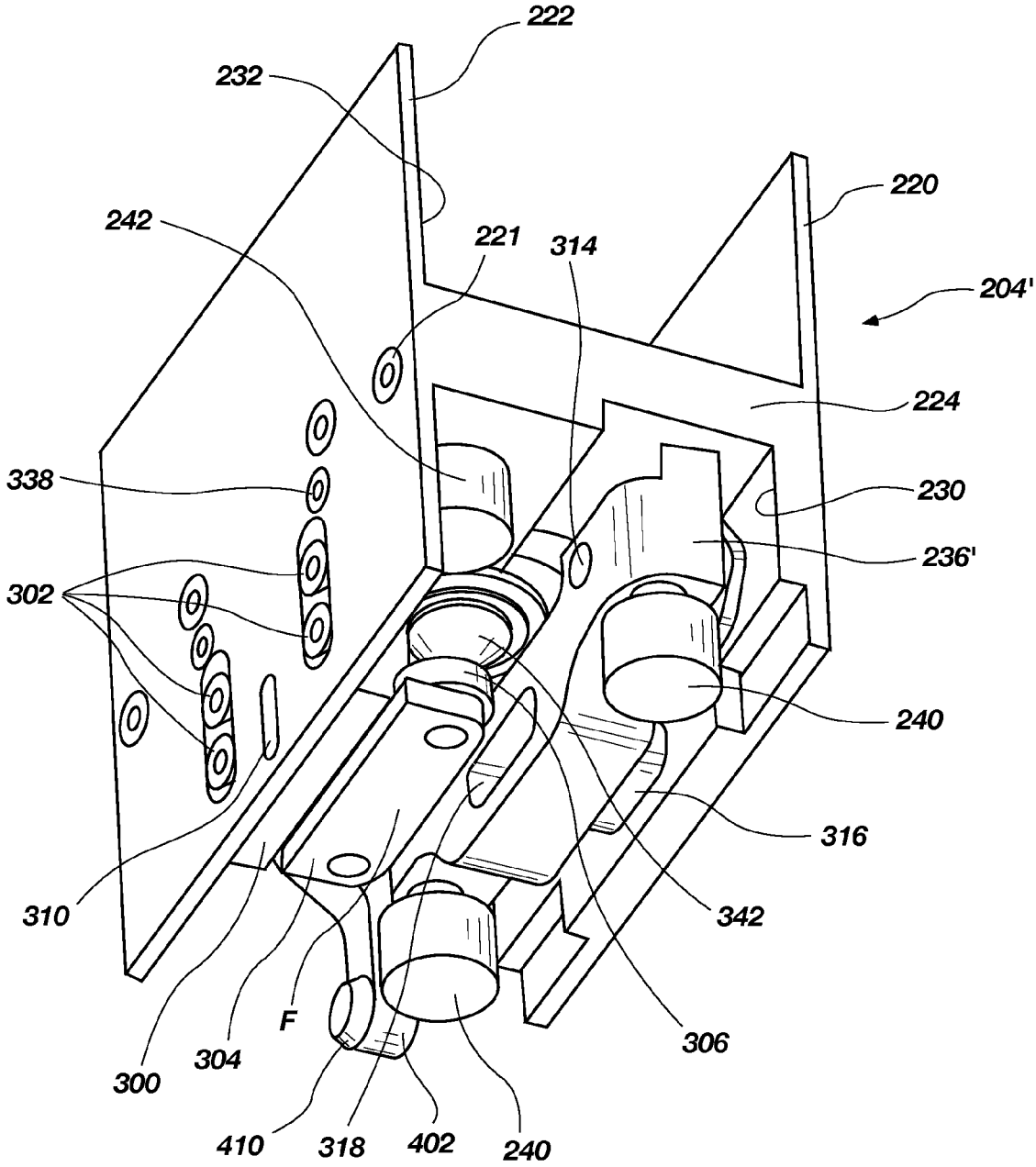
FIGS. 3C, 3D, 3E and 3F are four different, perspective views of another carriage configuration suitable for use in an embodiment of the invention.
Figure 3D:
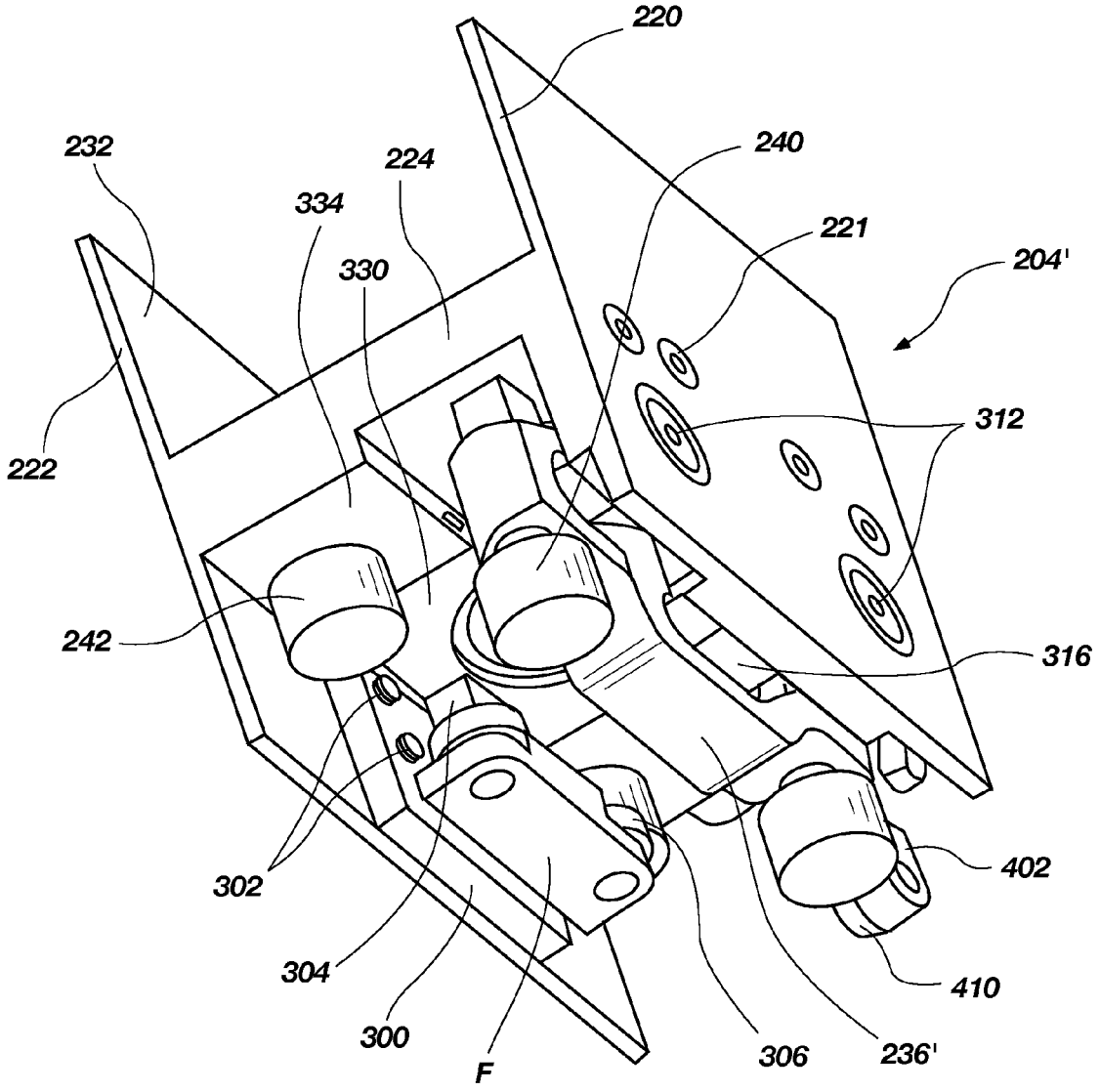
Figure 3E:
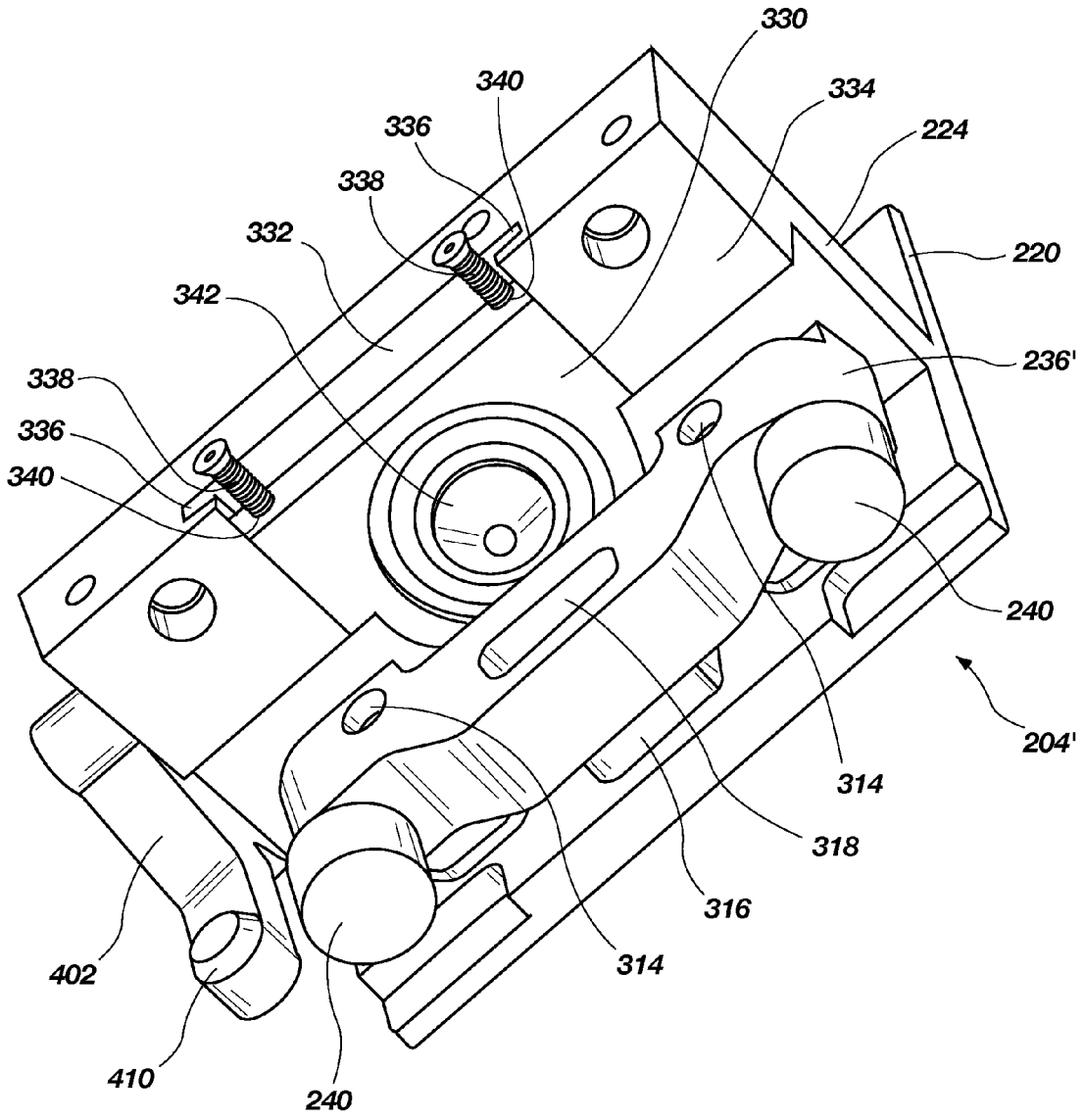
Figure 5:
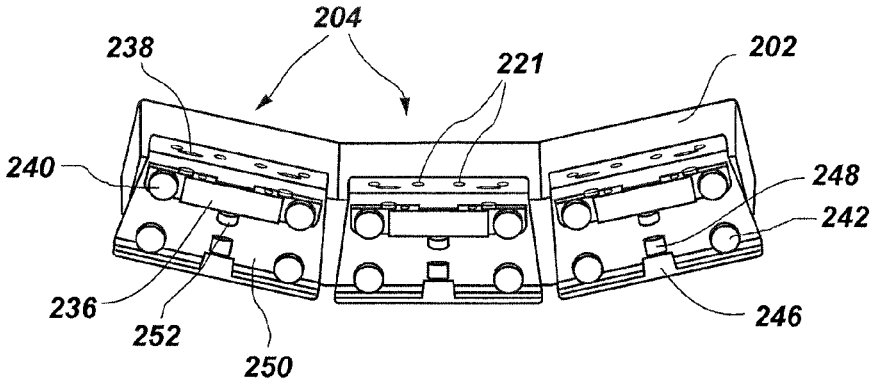
FIG. 5 is a bottom view of a group of carriages as depicted in FIGS. 3A and 3B mounted to the armor panel of FIGS. 4A-4C.

Referring to FIGS. 3A, 3B and 5, an embodiment of a carriage 204 comprises an "H" shaped configuration, taken from an end of the carriage 204. Inner and outer vertical plates 220 and 222 are joined by horizontal plate 224 extending therebetween. Threaded fasteners, such as set screws 221 are employed to secure each of inner and outer vertical plates 220, 222 to an opposing side of horizontal plate 224. Above horizontal plate 224, each of vertical plates 220 and 222 have mounting pads 226 of about ⅛inch to ¼inch thick, commercially available rubber bonded thereto, for example, by pre-applied adhesive tape, in mutually facing relationship across panel seat 228, defined between inner faces of 230 and 232 of vertical plates 220 and 222 and upper surface 234 of horizontal plate 224. Below horizontal plate 224, mounting plate 236 is secured to and inwardly and outwardly adjustable with respect to the inner face 230 of inner vertical plate 220 by fasteners 238, mounting plate 236 carrying two bearings in the form of rollers 240 thereon in mutually spaced relationship and positioned for rotation about a vertical axis. Adjacent outer vertical plate 222, two mutually spaced bearings in the form of rollers 242 are mounted to horizontal plate 224 by fasteners 244, and extend downwardly from horizontal plate 224 for rotation about a vertical axis. Midway along the inner face 232 of outer vertical plate 222 below horizontal plate 224, protrusion 246 has mounted thereto a cam follower in the form of roller 248 for rotation about a horizontal axis. Opposing roller 248 across rail cavity 250 is another bearing in the form of roller 252 mounted obliquely to mounting plate 236 for rotation about an axis substantially parallel to an angled upper face of a rail 208, 210 of rail system 206. Rollers 240, 242, 248 and 252 are each configured with needle bearings to facilitate smooth and nonbinding movement of carriage 204 on a rail 208, 210.

Referring to FIGS. 3C, 3D, 3E, 3F, 3G and 3H, another embodiment 204' of a carriage is depicted. Elements and features previously described with respect to carriage 204 with respect to FIGS. 3A and 3B are identified by the same or similar reference numerals in FIGS. 3C, 3D, 3E, 3F, 3G and 3H.

Rollers 242 are carried by carriage 204' by horizontal plate 224, adjacent outer vertical plate 222 in substantially the same positions and orientation as described with respect to carriage 204. Also depicted is outer block 300 mounted to the inner face 232 of outer vertical plate 222 between rollers 242. Outer block 300 is vertically adjustable on inner face 232 and is lockable at a desired vertical position with screws 302. Outer block 300 carries roller carriage 304 having inwardly extending, horizontal flange F (FIGS. 3C, 3D, 3G, 3H), from which rollers 306 project upwardly for rotation about a vertical axis. Roller carriage 304 is horizontally adjustable toward and away from outer vertical plate 222 to slide along inwardly protruding post P (FIG. 3G) press-fit into outer block 300 as adjustment screw 308 is turned, adjustment screw 308 being accessible from the outer surface of outer vertical plate 222 through slot 310.

Inner block 236' is mounted to inner face 230 of inner vertical plate 220. Inner block 236' is horizontally adjustable toward and away from inner vertical plate 220 with adjustment screws 312, which extend through inner vertical plate 220 from the outer surface thereof into apertures 314 in inner block 236', and rides on linear bushing 316, which projects inwardly from inner vertical plate 220 through cooperatively sized and shaped aperture 318 extending through inner block 236'. Inner block 236' carries downwardly extending rollers 240 mounted for rotation about a vertical axis.

Upper block 330 is keyed into recess 332 in the lower face 334 of horizontal plate 224 extending to outer vertical plate 222, wings (not shown) on each side of upper block 330 extending into slots 336, and is adjustable toward and away from outer vertical plate 222 with adjustment screws 338 that extend into threaded bores 340 in upper block 330 and the heads of which screws 338 are accessible on the outer surface of outer vertical plate 222. Upper block 330 carries downwardly extending, frustoconical roller 342. The cone angle of frustoconical roller 342 is selected to cooperate with the angle of an oblique bearing surface 278 on each rail 208, 210 as indicated below with respect to FIG. 6. Roller 342 is retained against cap plate 344 carried by upper block 330, and against low friction plate 346 by screw 348. Thrust bearing 350 mounted in upper block 330 surrounding roller 342 and over which outer skirt 352 extends, provides support and smooth rotational motion under applied force from contact with a correspondingly angled surface of a rail 208, 210.

Rollers 240, 242 and 342 are each configured with needle bearings to facilitate smooth and nonbinding movement of carriage 204' on a rail 208, 210. Rollers 306 are configured with ball bearings.

Figure 3F:
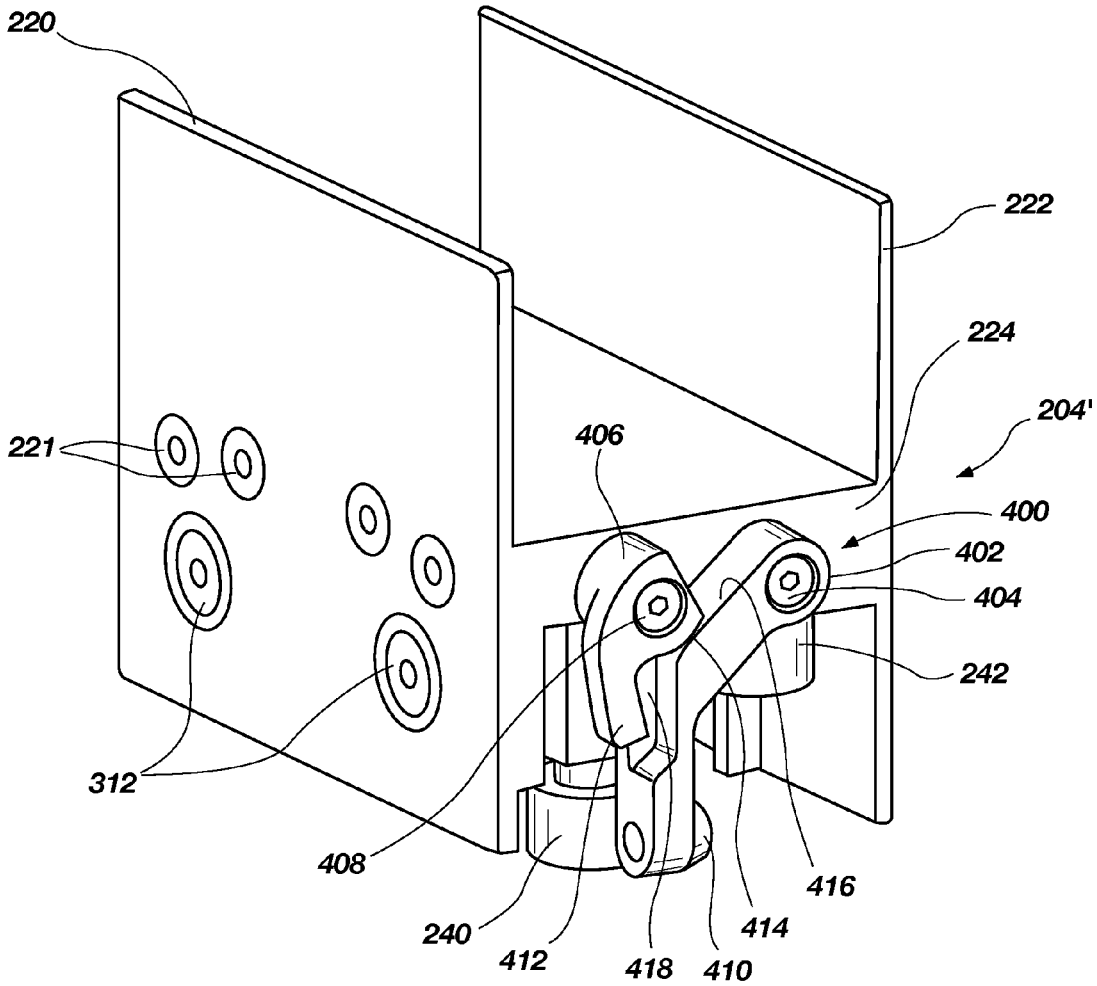
Figure 3G:
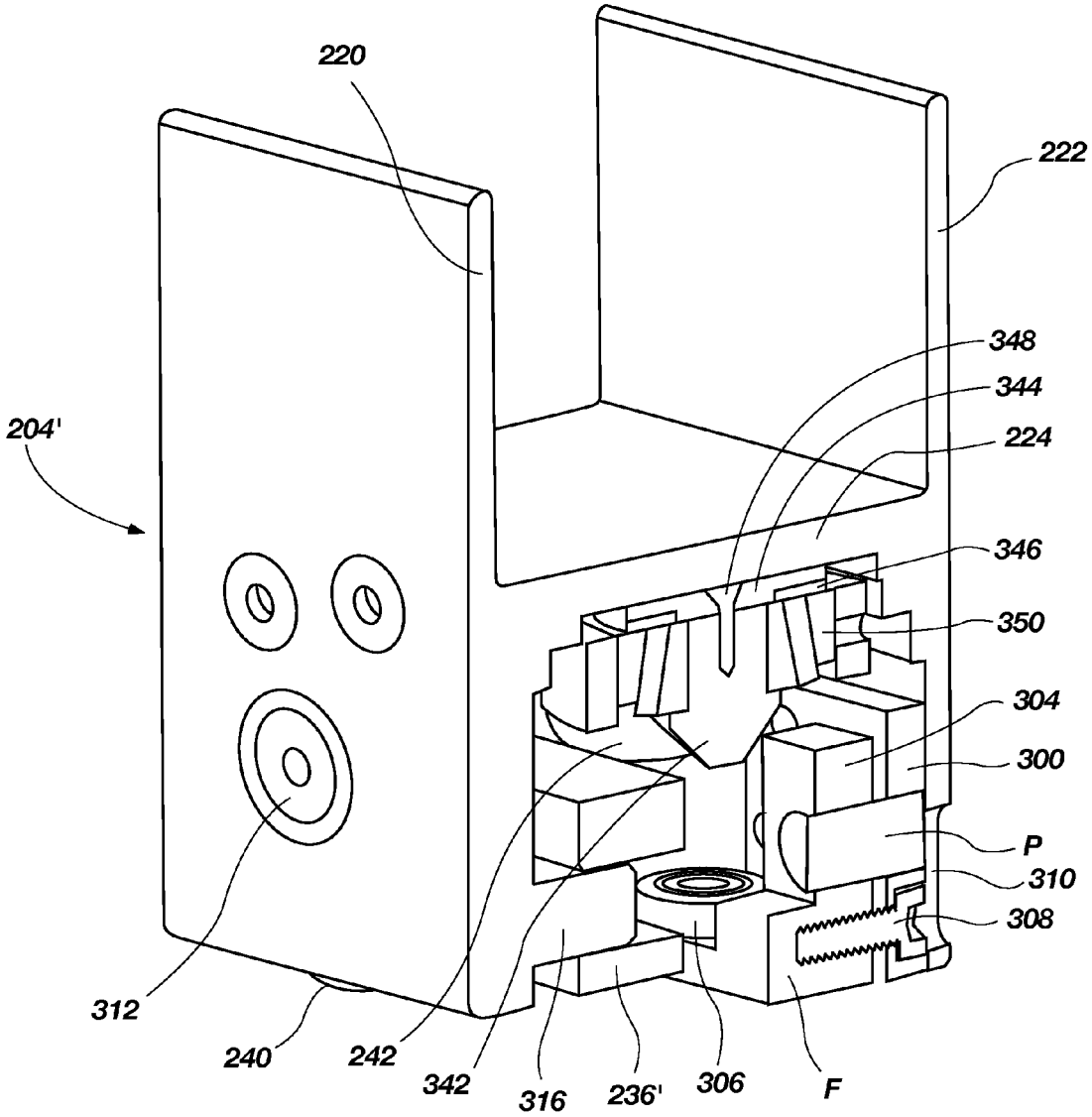
FIG. 3G is a perspective, transverse-sectional view of the carriage configuration of the carriage assembly depicted in FIGS. 3C, 3D, 3E and 3F.
Figure 3H:
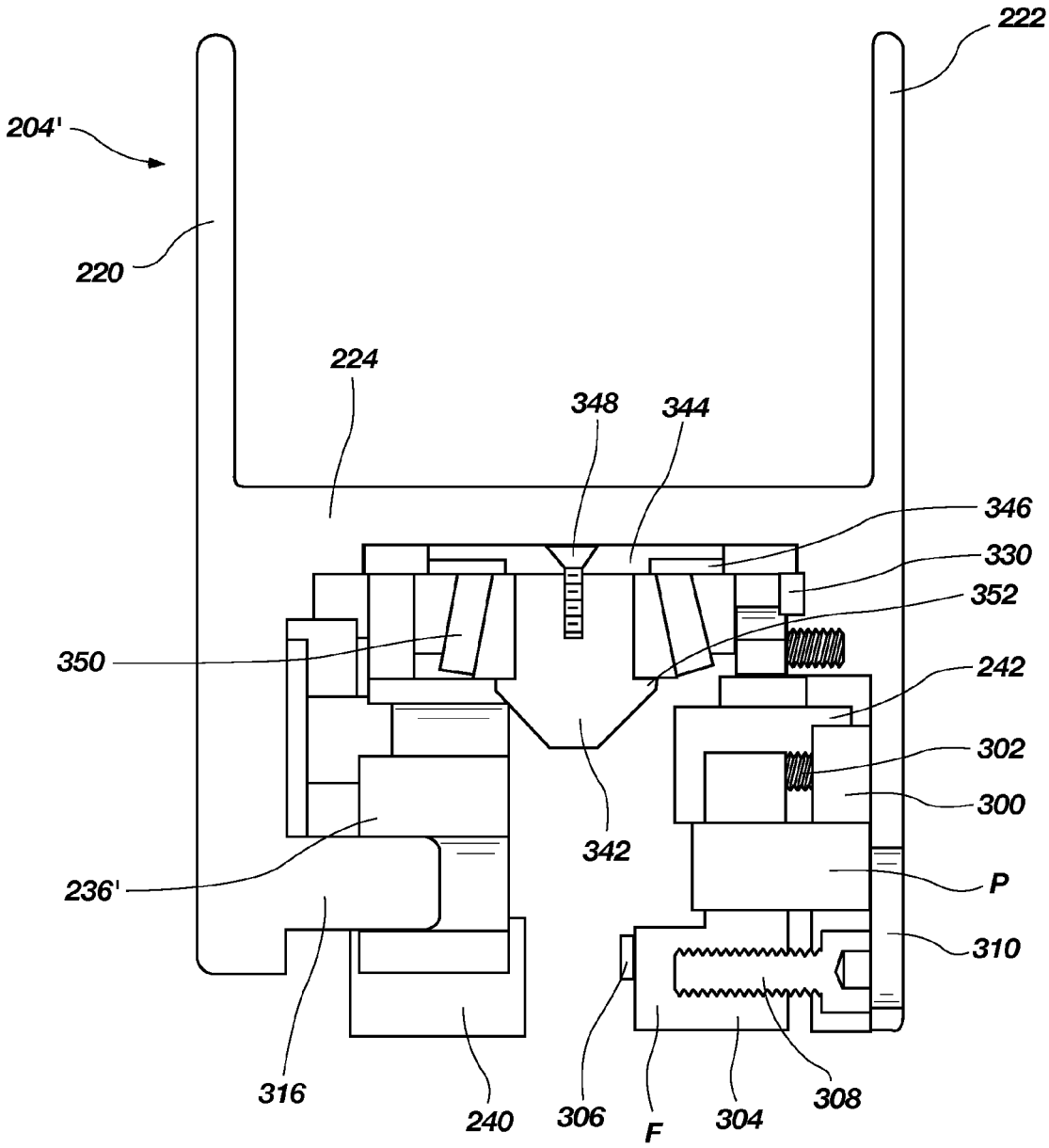
FIG. 3H is a transverse-sectional view of the carriage configuration of the carriage assembly depicted in 3C, 3D, 3E and 3F.

Cam lock assembly 400 (FIG. 3F) is carried on one side of a carriage 204 or 204', and comprises rail contact lever 402 mounted for rotation about axle 404 and an adjacent lock lever 406 mounted for rotation about axle 408, both axles 404 and 408 projecting from a common side of horizontal plate 224. The distal end of rail contact lever 402 carries an elastomeric pad 410 thereon. In lock position, as shown in FIG. 3F, distal end 412 of lock lever 406 is oriented downward and cam lock face 414 of lock lever 406 abuts lock seat 416 on the upper back surface of rail contact lever 402. Distal end 412 of lock lever 406 is offset outwardly from horizontal plate 224 sufficiently to be aligned with and partially received in lock recess 418 in the lower back surface of rail contact lever 402, such alignment precluding unwanted release of rail contact lever 402 from engagement with a rail 208, 210.

The interaction of carriages 204 and rails 208, 210 will be described further hereinbelow.

Figure 4A:
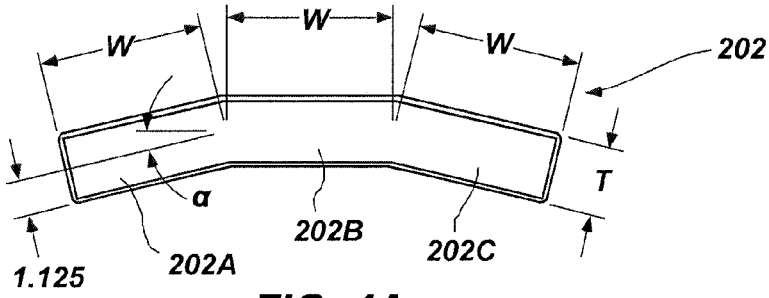
FIG. 4A is an end (bottom or top) view of an armor panel suitable for use with the embodiment of FIGS. 2A through 2C.
Figure 4B:
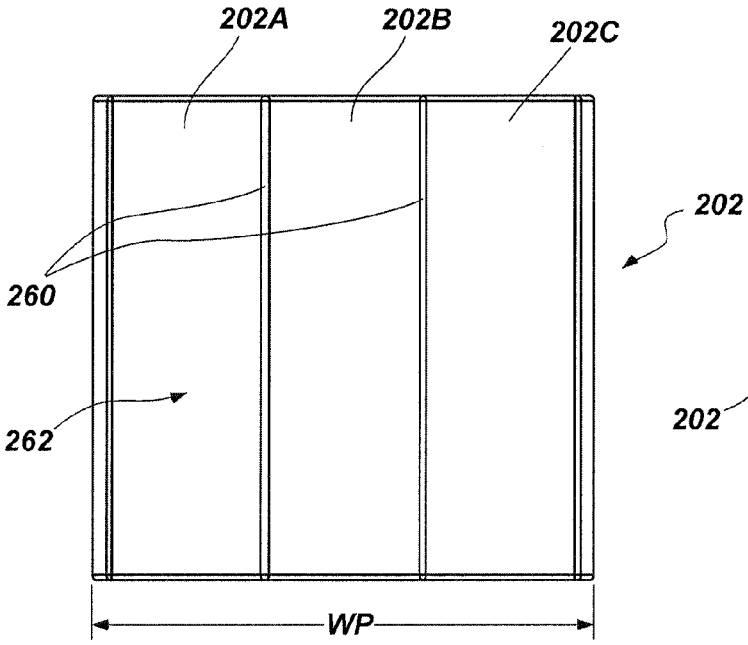
FIG. 4B is a rear elevation of the armor panel of FIG. 4A.
Figure 4C:
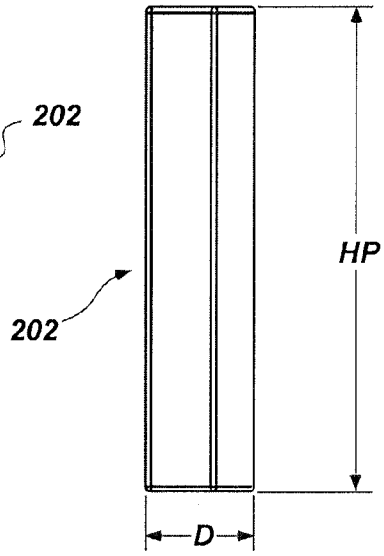
FIG. 4C is a side elevation of the armor panel of FIG. 4A.

Referring to FIGS. 4A through 4C, an embodiment of armor panel 202 is of substantially square configuration when viewed from a frontal or rear elevation, and comprises a plurality of segments, 202A, 202B and 202C, each mutually angled at an acute angles α to an adjacent segment 202A-202C. In one embodiment, α is 13.5°, but α may, of course, be varied to accommodate a given base ring radius for rail system 206. The armor panel 202 may, thus, be said to approximate a concave shape, taken in a direction parallel to a horizontal plane when the armor panel 202 is vertically oriented. In one embodiment, each armor panel 202 is, taken linearly from edge to edge, about sixteen inches wide WP, and about fifteen and a half inches high, HP. Each segment 202A-202C is about 2.25 inches thick T and, measured perpendicular to its thickness, about 5.25 inches wide W, not including additional widths 260 between segments 202A and 202B, and segments 202B and 202C, on outer face 262. The armor panel 202 is also, due to its concave configuration, about three inches deep D when viewed from a side (FIG. 4C). If armor panel 202 is configured as a composite armor panel 10, sides of adjacent silicon carbide tiles 102 in outermost functional layer 100 are butted very tightly together to minimize any gap therebetween. The outermost wrap 140 of fiberglass cloth, steel sheet 130 and the laid up 3TEX® laminate structure of base functional layer 120 provide side-to-side and vertical structural support. As noted previously, armor panel 202 may, but does not necessarily have to, exhibit the structure of composite armor panel 10 and, so armor panel 10 may be of the multi-segment, concave approximating configuration of armor panel 202. As noted above, armor panel 202 may be of continuously curved configuration, rather than comprised of flat panel segments collectively oriented to approximate a curve. In such an instance, the dimensions of an armor panel so configured may approximate those described above for armor panel 202.

Figure 6:
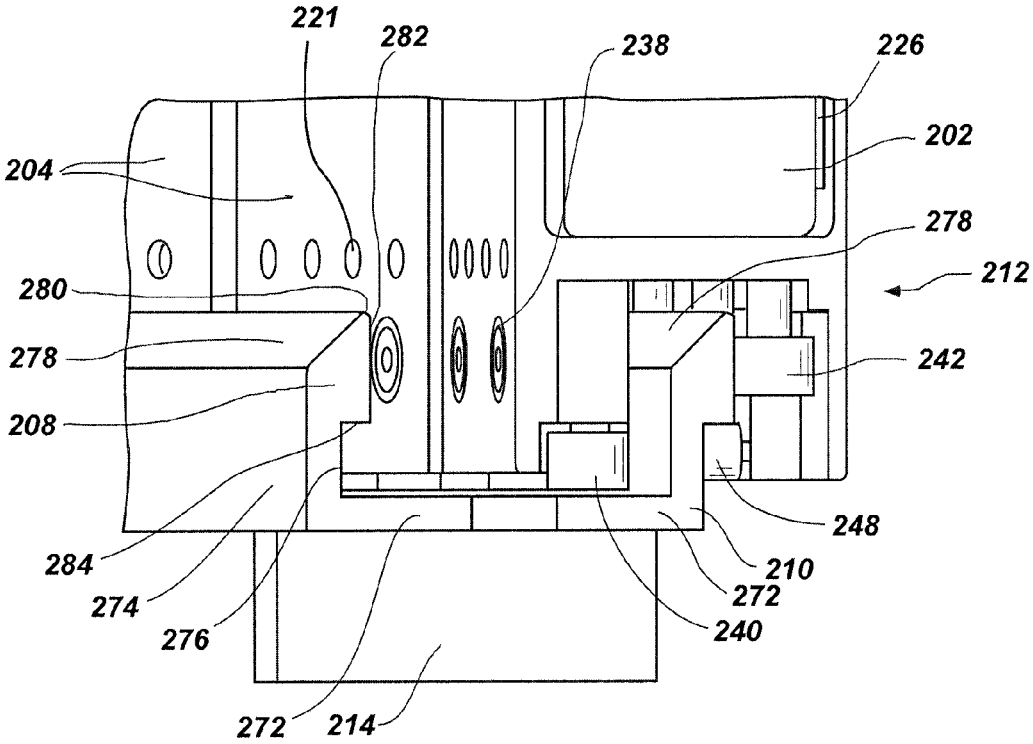
FIG. 6 is a side view of an armor panel mounted to a group of carriages and disposed on one rail of a rail system.
Figure 7:
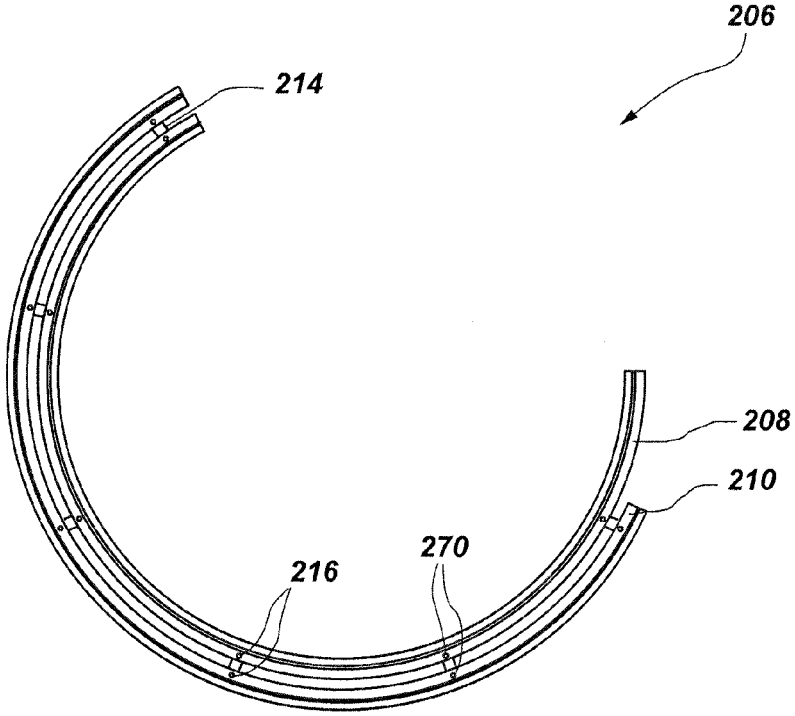
FIG. 7 is a top elevation of a rail system according to an embodiment of the invention.

Referring to FIGS. 5, 6 and 7, each armor panel 202 is mounted to a plurality of carriages, in this embodiment three carriages 204, one carriage 204 per each segment 202A-202C, to form a carriage assembly 212. Each carriage 204 is clamped into a segment 202A-202C, mounting pads 226 being compressed between the mounting pads 226 on the inner surfaces of inner and outer vertical plates 220, 222 of each carriage 204 as set screws 221 are made up to assemble the carriage 204. Thus, and as may be appreciated from FIG. 5, carriages 204 are placed so as to approximate an arc of a rail 208, 210 of rail system 206. All of the carriages 204 may be of the same configuration and dimensions for interchangeability. While individual carriages 204 are employed in the depicted embodiment, it is contemplated that a single carriage structure extending under all of the panel segments 202A-202C may be employed. Likewise, if a continuously curved armor panel is employed, a plurality of carriages 204 or a single, elongated carriage 204 configured with a panel seat curved to match a radius of curvature of the panel may be employed. Referring to FIG. 6, inner and outer rails 208, 210 of rail system 206 are shown in end view, with three carriages 204 bearing an armor panel 202 mounted to outer rail 210. In use and as noted above, rails 208, 210 of rail system 206 may be secured to a vehicle using fasteners 216 extending through apertures 270 periodically located in spaced relationship along the bases 272 of rails 208, 210 of rail system 206 and into supports 214 to enable removal of rails 208, 210 of rail system 206 from a vehicle without disengagement of supports 214 from bases 272. Inner and outer rails 208, 210 have substantially the same transverse cross-section with two vertical bearing walls 274 and 276, the inner vertical bearing wall 274 extending vertically above outer vertical bearing wall 276 (the terms "inner" and "outer" being used relative to an area enclosed by armor system 200, being to the left in FIG. 6) to an upper bearing surface 278 oriented at an angle, for example, 45° to the vertical and terminating at rounded upper edge 280, which meets outer vertical bearing wall 282 extending to horizontal bearing wall 284 extending inwardly to outer vertical bearing wall 276. As noted above, the angle of upper bearing surface 278 substantially matches the cone angle of frustoconical roller 342 of carriage 204' to ensure continuous, distributed-load engagement of the surface of roller 342 with upper bearing surface 278. The oblique angle of upper bearing surface 278 also facilitates shedding of debris to maintain smooth operation of carriage 204, 204' thereon. As depicted, when carriages 204 supporting an armor panel 202 are mounted to a rail, in this instance outer rail 210, rollers 240 bear against inner vertical bearing wall 274, rollers 342 bear against upper bearing surface 278, rollers 242 bear against outer vertical bearing wall 282, and rollers 248 bear against horizontal bearing wail 284. The rail system, or base ring, 206 distributes loads between armor panels 202 and the underlying vehicle structure arising from both common use applications (e.g., vehicle motion and panel movement) and dynamic ballistic events comprising impacts on the armor panels. The carriage assembly 212, as engaged with rail system 206, provides structure to facilitate movement of armor panels 202 along rail system 206, and to temporarily fix the armor panels 202 in place.

With reference to FIG. 6, it will be appreciated that inner vertical bearing wall 274, upper bearing surface 278, outer vertical bearing wall 282 and horizontal bearing wall 284 of rails 208, 210 each comprise a continuous arc corresponding to the arc of the rail 208, 210 of which they are a part. FIGS. 2D and 7 illustrate the curvature of rails 208, 210.

Carriage 204' when mounted on a rail 208, 210 engages the rail in a manner similar to that described with respect to carriage 204, rollers 240 bearing against inner vertical bearing wall 274, frustoconical roller 342 bearing against upper bearing surface 278, rollers 242 bearing against outer vertical bearing wall 282, and rollers 306 bearing against outer vertical wall 276. The previously described block adjustment mechanisms for outer block 300, inner block 236', and upper block 330 of carriage 204' enable easy mounting and dismounting of carriages 204' bearing an armor panel 202, and then pre-loading the bearing surfaces of the rail 208, 210 to which the carriages are mounted to remove slack from the mechanical system and prevent unwanted vibration during vehicle movement and projectile impact on armor panel 202 carried by carriage 204'. In such a manner, any substantial movement of a carriage assembly 212 in any direction transverse to a direction of elongation of a rail 208, 210 is precluded, while smooth travel on the rail 208, 210 is facilitated.

In addition, cam lock assembly 400 may be used to lock a panel 202 in position by engaging the inner vertical bearing surface 274 of a rail 208, 210 with elastomeric pad 410 on the distal end of rail contact lever 402 through downward rotation thereof, and locking rail contact lever 402 against inner vertical bearing surface 274 by downward rotation of lock lever 406 until the distal end 412 of lock lever 406 is oriented downward and cam lock face 414 of lock lever 406 abuts lock seat 416 on the upper back surface of rail contact lever 402. Distal end 412 of lock lever 406 is offset outwardly from horizontal plate 224 sufficiently to be aligned with and partially received in lock recess 418 in the lower back surface of rail contact lever 402, such alignment precluding unwanted release of rail contact lever from engagement with a rail 208, 210, for example, due to vehicle motion and impact shock of projectiles contacting an armor panel 202 carried by the carriage 204'.

Figure 8A:
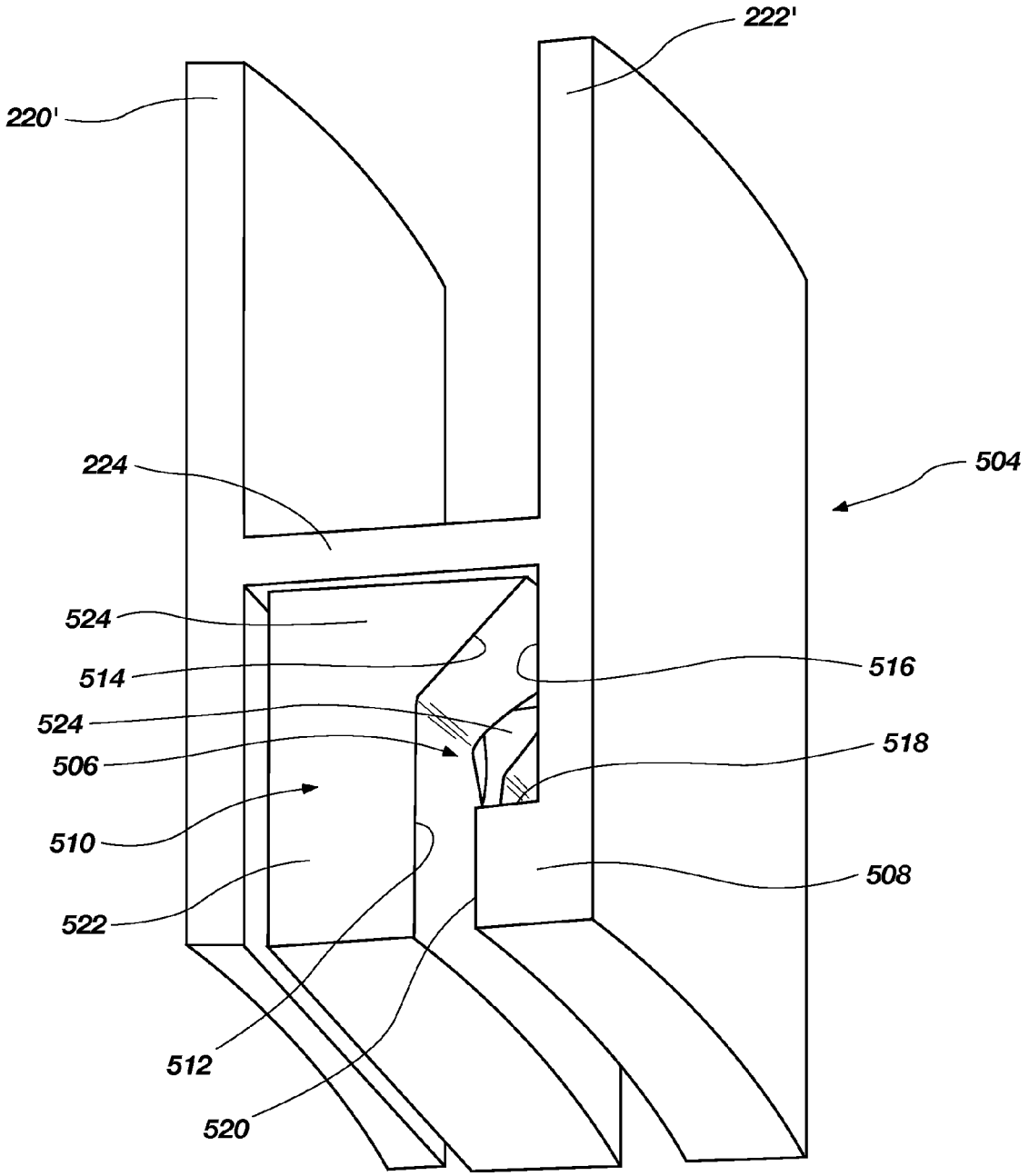
FIGS. 8A, 8B and 8C are three different, perspective views of another carriage configuration suitable for use in an embodiment of the invention.
Figure 8B:
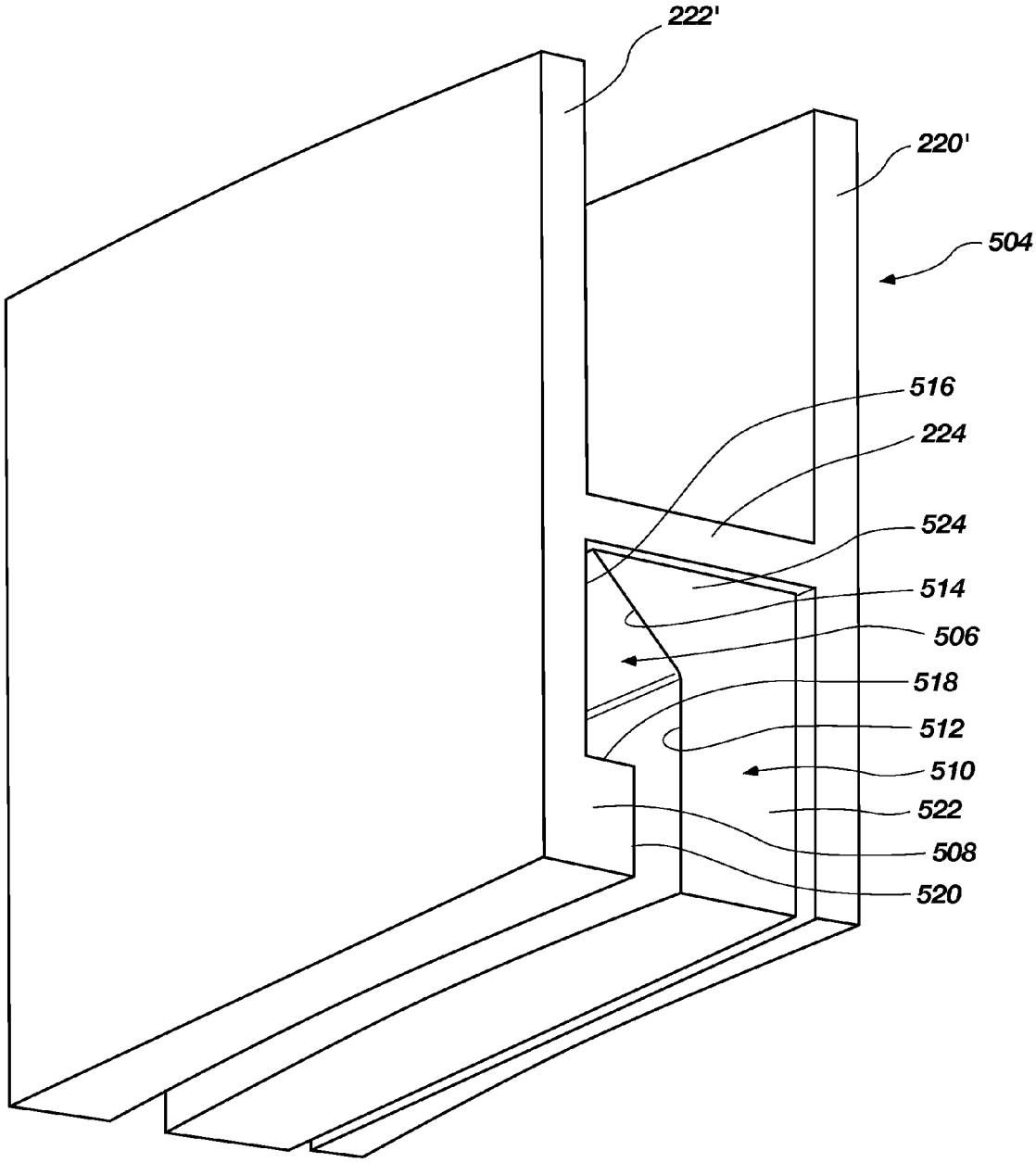
Figure 8C:
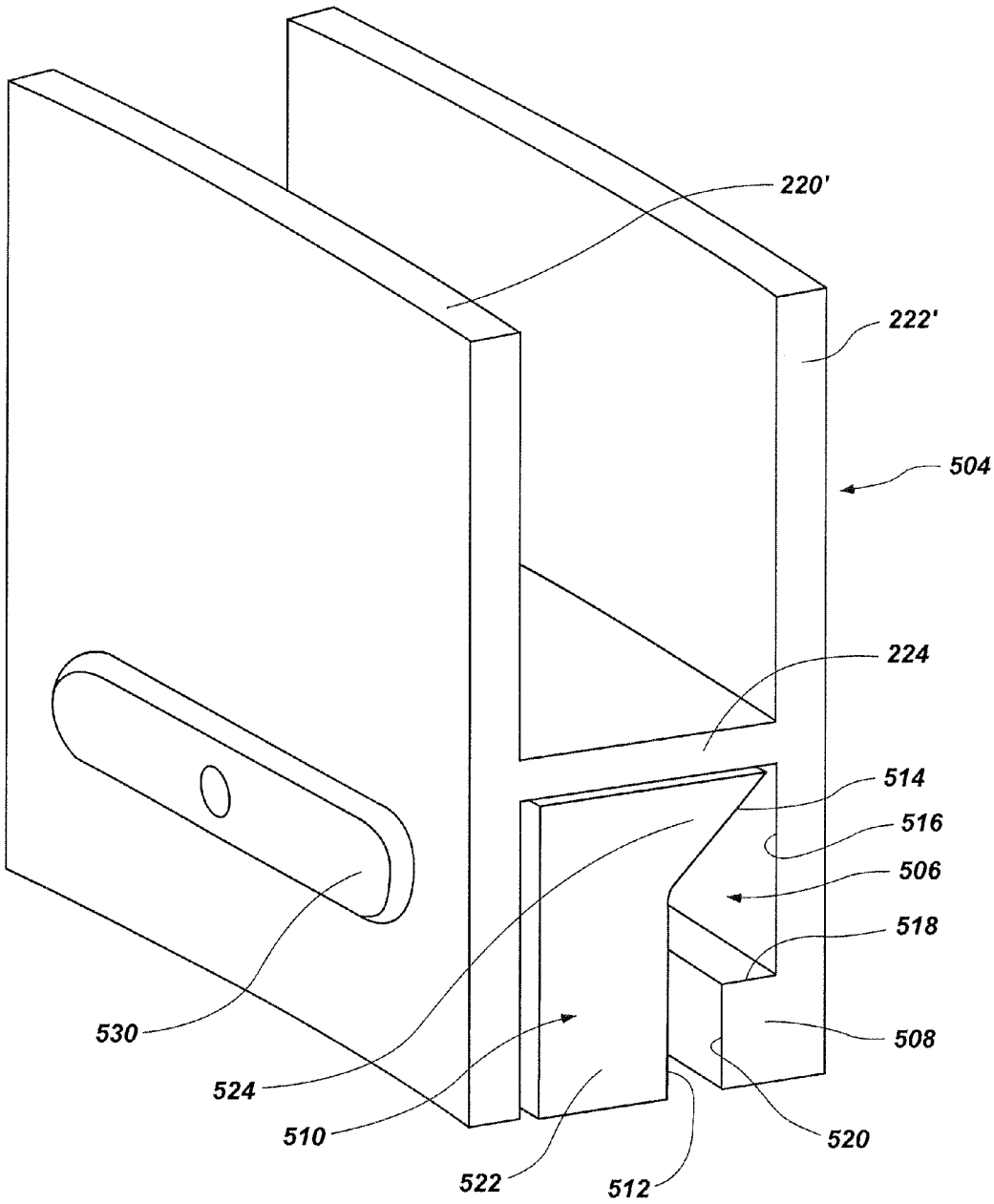

In a further embodiment, carriages 504 suitable for use with rail system 206 of armor system 200 may be configured without the use of rollers, for enhanced simplicity and reduced cost. In such an embodiment, carriages 504 are configured in an "H" shape, similar to the configurations of carriages 204 and 204'. However, carriages 504, as shown in FIGS. 8A through 8C, may be of arcuate (curved) configuration, to substantially match a radius of curvature of a rail 208, 210 of rail system 206. Further, carriage 504, as depicted, defines a rail slot 506 between outer vertical plate 222', which includes protrusion 508 at its lower extent, and bearing plate 510, which is secured to inner vertical plate 220'. Outwardly facing surfaces 512 and 514 of bearing plate 510 and a facing configuration of outer vertical plate 222' comprising surfaces 516, 518 and 520, are sized and oriented to respectively, slidably engage inner vertical bearing wall 274, upper bearing surface 278, outer vertical bearing wall 282, horizontal bearing wall 284 and outer vertical wall 276 (see FIG. 6) of a rail 208, 210. Thus, surfaces 512 through 520 may be said to define a slot profile approximating a cross-sectional profile of a rail 208, 210 to which carriage 504 may be mounted. Bearing plate 510 may be segmented, as shown, with a continuous base 522 and upstanding, separated prongs 524.

Smooth sliding operation of a carriage 504 may be facilitated by coating surfaces 512, 514, 516, 518 and 520 with a suitable low-friction material, such as a polytetrafluoroethylene (PTFE) coating, or PTFE-faced or PTFE-containing pads, or nylon pads may be used, for ease of replacement.

A carriage 504 may be locked in place using, for example, a cam lock assembly 400 such as has been previously described and illustrated herein. It is, however, contemplated that bearing plate 510 may be adjustable toward and away from inner vertical plate 220' to enable bearing plate 510 to selectively clamp a rail 208, 210 between bearing plate 510 and outer vertical wall 222'. Bearing plate 510 may be slidably mounted, for example, on horizontally oriented posts (not shown) extending outwardly from inner vertical plate 220' as previously described and illustrated with respect to components of carriage 204'. Brake element 530, schematically illustrated in FIG. 8C, may extend through an aperture in inner vertical wall 220' and be configured with a cam surface configured to engage an adjacent cam surface on bearing plate 510 (cam surfaces not shown) when brake element 530 is moved horizontally or vertically along inner vertical plate 220', in order to press bearing plate 510 against a rail 208, 210 and against outer vertical plate 222', clamping carriage 504 to rail 208, 210. Alternatively, bearing plate 510 may be spring-biased toward a clamping position, and pulled away from an associated rail 208, 210 using brake element 530 to release bearing plate 510. A stop, wedge or other detent mechanism may be employed to maintain bearing plate 510 in a retracted position against the spring force during sliding movement along a rail 208, 210, and then released to clamp carriage 504 in place.

Figure 9:
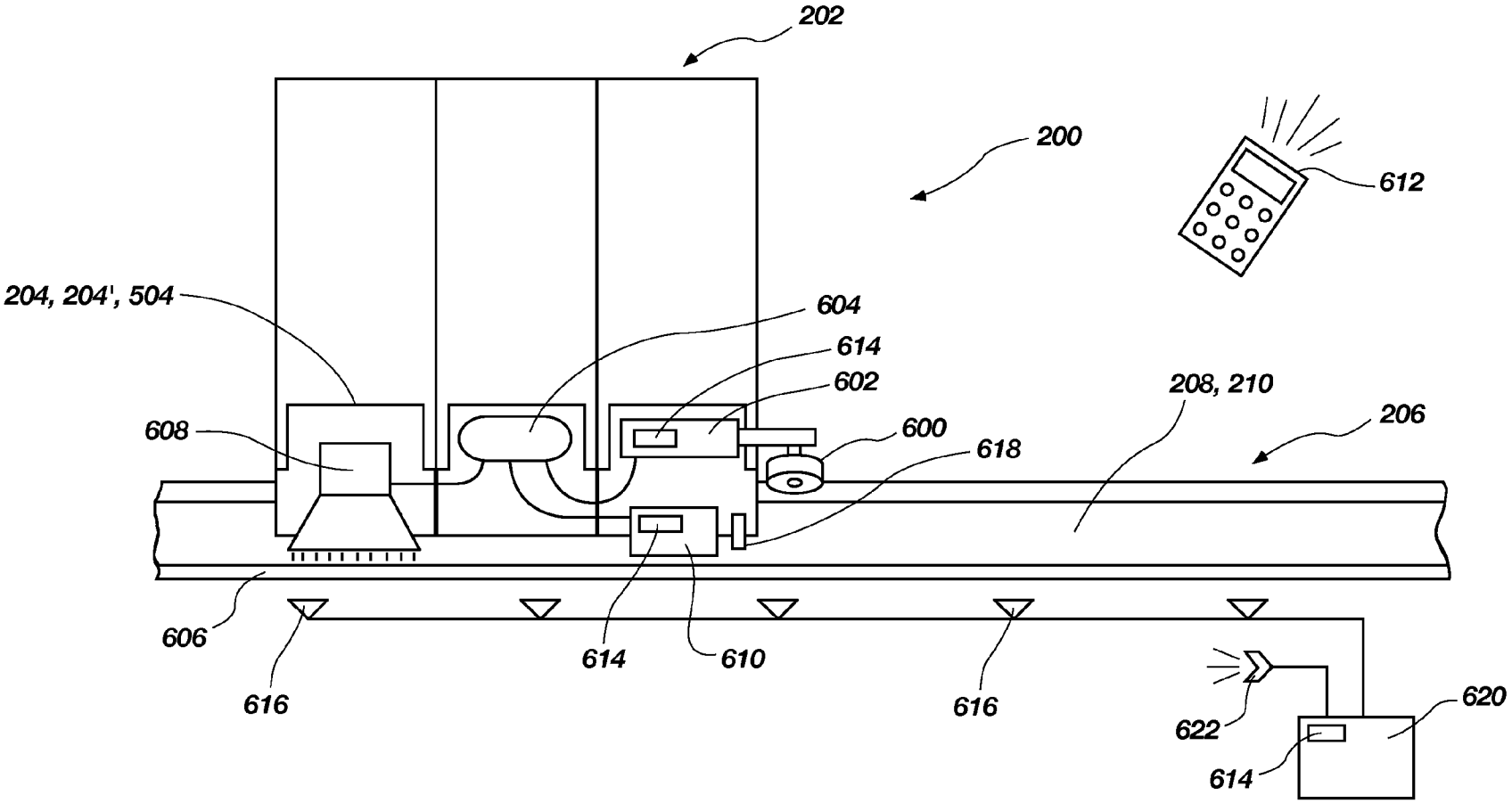
FIG. 9 is a schematic representation of an embodiment of the invention employing a motor-driven carriage and a carriage movement control apparatus.

In yet a further embodiment, as schematically illustrated in FIG. 9, the armor system 200 of the present invention may be configured to operate under power and, optionally, in a programmed manner. For example, a carriage or group of carriages 204, 204' or 504 may be provided with one or more drive rollers 600 driven by an electric drive motor 602 and in contact with a rail 208, 210 of rail system 206 to move the carriage 204, 204' or 504 and an associated armor panel 202. Power for the electric drive motor 602 may be provided, by way of non-limiting example, by rechargeable batteries 604 on a carriage 204, 204' or 504 or by inductive coupling using a power source transmitter 606 disposed under or adjacent to rails 208, 210 of a rail system 206 and a power receiver 608 carried by a carriage 204, 204' or 504. As a fail-safe power alternative and as depicted in FIG. 9, wherein a group of carriages 204, 204' or 504 supports an armor panel 202, inductive coupling using a power receiver 608 may be employed both to provide power to electric drive motor 602 and to maintain a charge in an associated rechargeable battery 604 to ensure operation of electric drive motor 602 if power is disrupted. As shown, if a plurality of carriages 204, 204' or 504 is linked together, only one carriage 204, 204' or 504 need be powered. Similarly, a locking mechanism 610 to selectively fix a carriage or group of carriages 204, 204' or 504 in place at a desired position along a rail 208, 210 may be electrically powered and solenoid-driven to a locking position against a spring-biased release position, so that carriage movement may always be ensured in case of a power failure. A simple, low power, radiofrequency remote control 612 with different frequencies for control of electric drive motors 602 and locking mechanisms 610 for different carriages or groups, and receivers 614 associated with the electric motors 602 and locking mechanisms 610, may be employed for carriage movement control. Thus, a carriage or group of carriages 204, 204' or 504 may be moved to a desired shielding position, with respect to a vehicle hatch, by an operator stationed within a vehicle carrying an armor system 200 without risk of exposure of the operator to hostile fire.

If desired, a plurality of proximity sensors 616 may be placed in spaced relationship along the inward, protected side of the rails 208, 210 of rail system 206 and different proximity sensors 616 actuated under control of remote control 612 via a microprocessor or other controller 620 having a receiver 614 associated therewith upon initiation of driven carriage movement depending on the desired destination position of a given carriage or carriages 204, 204' or 504. Upon reaching a destination proximity sensor 616, a sensor trigger element 618 borne by a carriage 204, 204' or 504 will trip that proximity sensor 616 and cause power to the electric drive motor 602 of the driven carriage or group of carriages 204, 204' or 504 to be cut via a signal generated by transmitter 622 associated with microprocessor or controller 620, and power to an associated locking mechanism 610 applied to lock the carriage or carriages 204, 204' or 504 and their associated armor panels 202 in place. As an alternative to the use of proximity sensors, a rotary encoder (not shown) may be employed in conjunction with a drive roller 600 to measure carriage travel against a programmed distance, and stop the carriage when the programmed distance is reached.

While the invention is susceptible to various modifications and alternative forms, specific embodiments of which have been shown by way of example in the drawings and have been described in detail herein, it should be understood that the invention is not limited to the particular forms disclosed. Rather, the invention includes all modifications, equivalents, and alternatives falling within the scope of the invention as defined by the following appended claims and their legal equivalents.

The invention claimed is:

1. An armor system, comprising:

a rail system comprising a plurality of substantially constantly spaced, laterally adjacent elongated rails;

a plurality of carriage assemblies, each carriage assembly of the plurality of carriage assemblies including an armor panel supported by at least one carriage;

wherein each carriage assembly of the plurality of carriage assemblies is mounted in substantially upright orientation to a single rail among the plurality of rails for displacement along a length of the single rail; and wherein each rail among the plurality of rails has mounted thereto at least one carriage assembly.

2. The armor system of claim 1, wherein at least one armor panel comprises a composite armor panel, comprising:

an outermost layer including an array of mutually adjacent silicon carbide tiles;

an intermediate layer comprising a plurality of silicon carbide particles disposed in a polymeric resin matrix;

a base layer comprising a plurality of plies of fiberglass cloth impregnated in a resin system;

a steel sheet disposed over the outermost layer; and a resin-impregnated fiberglass cloth wrapped about the steel sheet, the outermost layer, the intermediate layer and the base layer.

3. The armor system of claim 2, wherein the silicon carbide tiles comprise substantially square tiles having a minimum density of about 3.15 g/cm$^3$, and each tile is individually wrapped in 0° and 90° orientations with respect to a major plane of the tile with a structure of unidirectional carbon fibers impregnated with a resin system.

4. The armor system of claim 3, wherein the unidirectional carbon fiber has a weight of about 200 g/m$^2$ and a resin content of about 28% by weight.

5. The armor system of claim 1, wherein the silicon carbide particles comprise particles of at least about 7 mm in diameter and no more than about 9 mm in diameter.

6. The armor system of claim 1, wherein the intermediate layer is wrapped in 0° and 90° orientations with respect to a major plane of the intermediate layer in a resin-impregnated fiberglass cloth.

7. The armor system of claim 6, wherein the fiberglass cloth comprises 100 oz. 3WEAVE® S2 Fabric.

8. The armor system of claim 1, wherein the plurality of plies of fiberglass cloth comprises at least nine and not more than thirteen plies.

9. The armor system of claim 1, wherein the steel sheet comprises one-sixteenth-inch thick carbon sheet steel.

10. The armor system of claim 1, wherein the resin-impregnated fiberglass cloth is wrapped in 0° and 90° orientations with respect to a major plane of the composite armor panel.

11. The armor system of claim 1, wherein the plurality of rails consists of two rails.

12. The armor system of claim 1, further comprising a lock assembly carried by at least some of the carriages, the lock assembly configured to engage and selectively lock an associated carriage to a rail.

13. The armor system of claim 1, wherein at least one rail of the plurality is longer than at least one other rail of the plurality.

14. The armor system of claim 1, further comprising:

a drive motor carried by at least one carriage of the plurality of carriage assemblies and operably coupled to a drive roller positioned in contact with a surface of a rail; and a power source for the drive motor.

15. An armor system, comprising:

a rail system comprising a plurality of substantially constantly spaced, laterally adjacent elongated rails;

a plurality of carriage assemblies, each carriage assembly of the plurality of carriage assemblies including an armor panel supported by at least one carriage, wherein:

each carriage is configured in an "H" shaped transverse cross-section comprising a vertical inner plate, a vertical outer plate, and a horizontal plate extending therebetween; and a panel seat located between the horizontal plate and inner surfaces of the inner and outer plates above the horizontal plate receives a lower portion of an armor panel therein;

wherein each carriage assembly of the plurality of carriage assemblies is mounted to a rail among the plurality of rails for displacement along a length of the rail; and wherein each rail among the plurality of rails has mounted thereto at least one carriage assembly.

16. The armor system of claim 15, wherein at least some carriages further comprise:

a plurality of rollers mounted between the inner and outer plates and below the horizontal plate to engage a rail for the displacement therealong while precluding substantial movement of the carriage assembly transversely to a direction of elongation of the rail.

17. The armor system of claim 15, wherein at least some carriages further comprise a bearing plate mounted to the vertical inner plate below the horizontal plate, secured to the vertical inner plate for movement toward and away from the vertical inner plate, the bearing plate having outwardly facing surfaces configured, in combination with a facing configuration of the vertical outer plate, to define a slot profile approximating a cross-sectional profile of a rail to which the carriage is mounted.

18. The armor system of claim 15, further comprising a plurality of mounting pads, at least one mounting pad of the plurality disposed on the inner surface of the inner plate and at least another mounting pad of the plurality disposed on the inner surface of the outer plate, the plurality of mounting pads engaging the lower portion of the armor panel.

19. An armor system, comprising:

a rail system comprising a plurality of substantially constantly spaced, laterally adjacent elongated rails, wherein the rail system is configured as at least a portion of a ring;

a plurality of carriage assemblies, each carriage assembly of the plurality of carriage assemblies including an armor panel supported by at least one carriage, each armor panel comprising a plurality of panel segments, each panel segment angled at an acute angle to an adjacent panel segment, the armor panel approximating a concave shape, taken parallel to a horizontal plane when the armor panel is vertically oriented;

wherein each carriage assembly of the plurality of carriage assemblies is mounted to a rail among the plurality of rails for displacement along a length of the rail; and wherein each rail among the plurality of rails has mounted thereto at least one carriage assembly.

20. The armor system of claim 19, wherein a lower portion of each panel segment is seated in a different carriage.

21. An armor system, comprising:

a rail system comprising a plurality of substantially constantly spaced, laterally adjacent elongated rails;

a plurality of carriage assemblies, each carriage assembly of the plurality of carriage assemblies including an armor panel supported by at least one carriage, wherein each armor panel comprises:

an outermost layer including an array of mutually adjacent silicon carbide tiles;

an intermediate layer comprising a plurality of silicon carbide particles disposed in a polymeric resin matrix;

a base layer comprising a plurality of layers of fiberglass cloth impregnated in a resin system;

a steel sheet disposed over the outermost layer; and a resin-impregnated fiberglass cloth wrapped about the steel sheet, the outermost layer, the intermediate layer and the base layer;

wherein each carriage assembly of the plurality of carriage assemblies is mounted to a rail among the plurality of rails for displacement along a length of the rail; and wherein each rail among the plurality of rails has mounted thereto at least one carriage assembly.

22. A vehicle, comprising:

an armor system comprising:

a rail system comprising a plurality of substantially constantly spaced, laterally adjacent rails mounted to the vehicle;

a plurality of carriage assemblies, each carriage assembly of the plurality of carriage assemblies including an armor panel supported by at least one carriage;

wherein each carriage assembly of the plurality of carriage assemblies is mounted in a substantially upright orientation to a single rail among the plurality of rails for displacement along a length of the single rail; and wherein each rail among the plurality of rails has mounted thereto at least one carriage assembly.

* * * * *

UNITED STATES PATENT AND TRADEMARK OFFICE

CERTIFICATE OF CORRECTION

PATENT NO. : 8,342,073 B2
APPLICATION NO. : 12/510014
DATED : January 1, 2013
INVENTOR(S) : Henry S. Chu et al.

It is certified that error appears in the above-identified patent and that said Letters Patent is hereby corrected as shown below:

In the specification:

| | | |
|---|---|---|
| COLUMN 5, | LINE 16, | change “base functionional” to --base functional-- |
| COLUMN 5, | LINE 19, | change “S2Fabric,” to --S2 Fabric,-- |
| COLUMN 7, | LINE 37, | change “1/8inch to 1/4inch” to --1/8 inch to 1/4 inch-- |

Signed and Sealed this
Twenty-second Day of December, 2015

Michelle K. Lee

Michelle K. Lee
*Director of the United States Patent and Trademark Office*